US009725216B2

(12) United States Patent
Alvarez

(10) Patent No.: US 9,725,216 B2
(45) Date of Patent: Aug. 8, 2017

(54) BEVERAGE CONTAINER COVERS, METHODS AND USES THEREOF

(71) Applicant: Manuel H. Alvarez, Santa Ana, CA (US)

(72) Inventor: Manuel H. Alvarez, Santa Ana, CA (US)

( * ) Notice: Subject to any disclaimer, the term of this patent is extended or adjusted under 35 U.S.C. 154(b) by 91 days.

(21) Appl. No.: 14/335,196

(22) Filed: Jul. 18, 2014

(65) Prior Publication Data

US 2016/0016701 A1 Jan. 21, 2016

(51) Int. Cl.

| | |
|---|---|
| ***B65D 25/00*** | (2006.01) |
| ***B65D 43/06*** | (2006.01) |
| ***B65D 81/38*** | (2006.01) |
| ***B65B 5/04*** | (2006.01) |
| ***A47G 19/22*** | (2006.01) |

(52) U.S. Cl.

CPC ..... *B65D 43/06* (2013.01); *A47G 19/22* (2013.01); *B65B 5/04* (2013.01); *B65D 81/3876* (2013.01)

(58) Field of Classification Search

CPC ..... B65D 43/06; B65D 81/3876; B65D 5/04; B65D 43/265; A47G 23/0233; A47G 23/0208; A47G 23/02106; A47G 19/22; B65B 5/04; A45F 2200/0583; A61J 1/16

USPC ..... 220/740

See application file for complete search history.

(56) References Cited

U.S. PATENT DOCUMENTS

| | | | | | |
|---|---|---|---|---|---|
| 318,887 | A * | 5/1885 | Eustis | A47G 23/0233 | 206/446 |
| 795,930 | A * | 8/1905 | Perkins | A47G 23/0233 | 220/740 |
| 1,731,405 | A * | 10/1929 | Adamczyk | A47G 23/0233 | 215/237 |
| 2,552,397 | A * | 5/1951 | Bretney | A47G 23/0233 | 215/236 |
| 2,749,727 | A * | 6/1956 | Fabro | A47G 23/0233 | 215/236 |
| 2,936,149 | A * | 5/1960 | Reeg | A47G 23/0233 | 248/313 |
| 3,203,598 | A * | 8/1965 | Alford | A47G 23/0233 | 222/183 |

(Continued)

*Primary Examiner* — Fenn Mathew
*Assistant Examiner* — Don M Anderson
(74) *Attorney, Agent, or Firm* — Sandra P. Thompson; Slater Hersey & Lieberman LLP

(57) ABSTRACT

A beverage container cover is disclosed herein and includes: a solid strip stabilizing component, a cover component, wherein the solid strip stabilizing component is hingeably coupled to the cover component, and a handle component that is operatively coupled to the stabilizing component and the cover component. A beverage container cover is disclosed herein and includes: a solid strip stabilizing component, a cover component, wherein the solid strip stabilizing component is hingeably coupled to the handle component, and a handle component that is operatively coupled to the stabilizing component and the cover component. In addition, a beverage container cover system is disclosed that includes: a beverage container cover, a beverage container, and an insulating cover, wherein the beverage container is surrounded in part by the insulating cover and wherein the solid strip stabilizing component of the beverage container cover is located in the space between the beverage container and the insulating cover.

4 Claims, 4 Drawing Sheets

(56) References Cited

U.S. PATENT DOCUMENTS

| | | | | | |
|---|---|---|---|---|---|
| 3,719,305 | A * | 3/1973 | Pressnell | A47G 23/0233 | 215/395 |
| D258,712 | S * | 3/1981 | Jacobson | A47G 23/0233 | D7/317 |
| 4,312,465 | A * | 1/1982 | Sinkhorn | B62J 11/00 | 220/475 |
| 4,643,326 | A * | 2/1987 | Klingler | A47G 23/0233 | 220/212.5 |
| 4,735,333 | A * | 4/1988 | Lay | B65D 81/3886 | 220/739 |
| 4,872,577 | A * | 10/1989 | Smith | B65D 51/04 | 220/264 |
| 4,927,047 | A * | 5/1990 | Stuber | B65D 81/3879 | 206/805 |
| 5,186,350 | A * | 2/1993 | McBride | A47G 23/0233 | 206/818 |
| 5,740,940 | A * | 4/1998 | Weiss | B65D 81/3886 | 220/326 |
| 5,848,722 | A * | 12/1998 | Hanes | A47G 23/0233 | 215/387 |
| 6,039,207 | A * | 3/2000 | Adamek | B65D 81/3879 | 215/303 |
| 6,244,461 | B1 * | 6/2001 | Roberts | A47G 23/0233 | 220/740 |
| D591,563 | S * | 5/2009 | Johnson | A47G 23/0233 | D7/624.2 |
| 9,038,850 | B1 * | 5/2015 | Wilson | A47G 19/2272 | 220/758 |
| 2005/0269325 | A1 * | 12/2005 | Belcastro | A47G 23/0233 | 220/254.3 |
| 2012/0305571 | A1 * | 12/2012 | Larsen | B65D 81/3886 | 220/592.17 |

* cited by examiner

BEVERAGE CONTAINER COVERS, METHODS AND USES THEREOF

FIELD OF THE SUBJECT MATTER

The field of the subject matter is an open-container beverage container cover that can be used contemporaneously with drinking the beverage.

BACKGROUND

Throughout the year, people entertain outside and in open spaces where guests will select, take and open or pour a beverage into a container or drink a beverage out of its original container, such as a can or bottle. If the get-together is outside or even sometimes in a home or building, the drinks can get dust, dirt or bugs in them.

In addition, wine charms have become popular, in that at parties, someone will take a specific wine charm, put it on his or her glass and use it to identify his or her glass throughout the event. These charms are ideal, because guests don't have to waste wine or use multiple glasses during the event, but instead can have one glass and use it throughout the night with the knowledge that the wine in the glass has not been consumed by anyone else.

To this end, it would be desirable to develop, produce and utilize a small, but effective system and apparatus for covering a beverage container that is currently in use by the person drinking the beverage. It would also be useful if systems and apparatus were able to be identified to the user, so that someone drinking a similar drink doesn't mistake his or her container for another one.

SUMMARY OF THE SUBJECT MATTER

A beverage container cover is disclosed herein and includes: a solid strip stabilizing component, a cover component, wherein the solid strip stabilizing component is hingeably coupled to the cover component, and a handle component that is operatively coupled to the stabilizing component and the cover component.

A beverage container cover is disclosed herein and includes: a solid strip stabilizing component, a cover component, wherein the solid strip stabilizing component is hingeably coupled to the handle component, and a handle component that is operatively coupled to the stabilizing component and the cover component.

In addition, a beverage container cover system is disclosed that includes: a beverage container cover, a beverage container, and an insulating cover, wherein the beverage container is surrounded in part by the insulating cover and wherein the solid strip stabilizing component of the beverage container cover is located in the space between the beverage container and the insulating cover.

BRIEF DESCRIPTION OF THE FIGURES

A beverage container cover, as described herein, comprises a solid strip stabilizing component hingeably coupled to a cover component, and a handle component that is operatively coupled to the stabilizing component and the cover component, which is shown in FIG. 1.

A contemplated solid strip stabilizing component has a first end, a second end and a body that extends between the first and second end. The second end and the body, in this embodiment, is designed to be slipped down between a glass, bottle or can and an insulating cover for the glass, bottle or can—oftentimes called a coozie or koozie, which is shown in FIG. 2 for a can, FIG. 3 for a bottle, and FIG. 4 for a glass, such as a beer glass.

Figure 5:
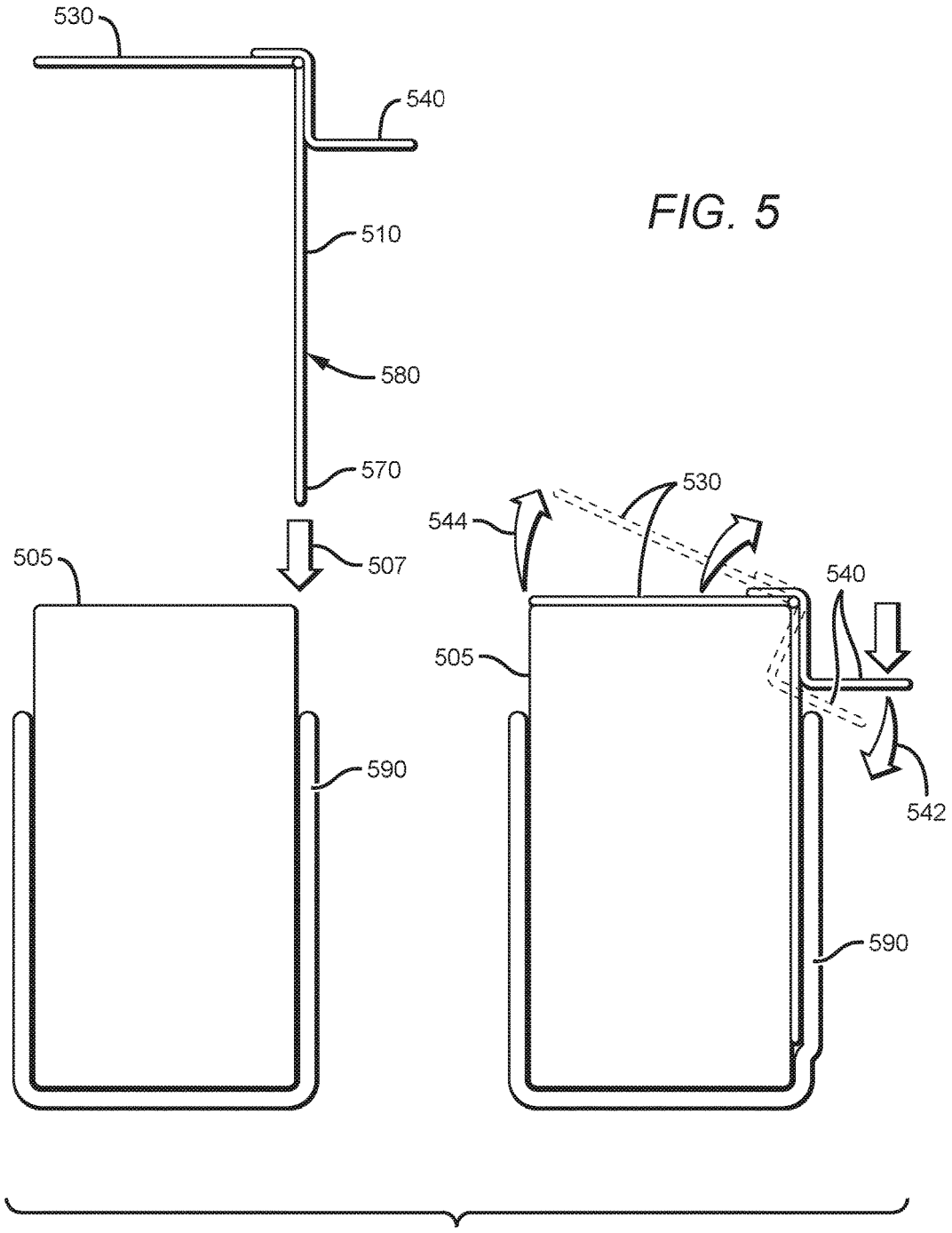

Once the second end and body of the solid strip stabilizing component is slid down between the glass, bottle or can and the insulating cover, the cover component moves to sit on top of the opening of the glass, bottle or can, which is shown in FIG. 5.

Figure 6:
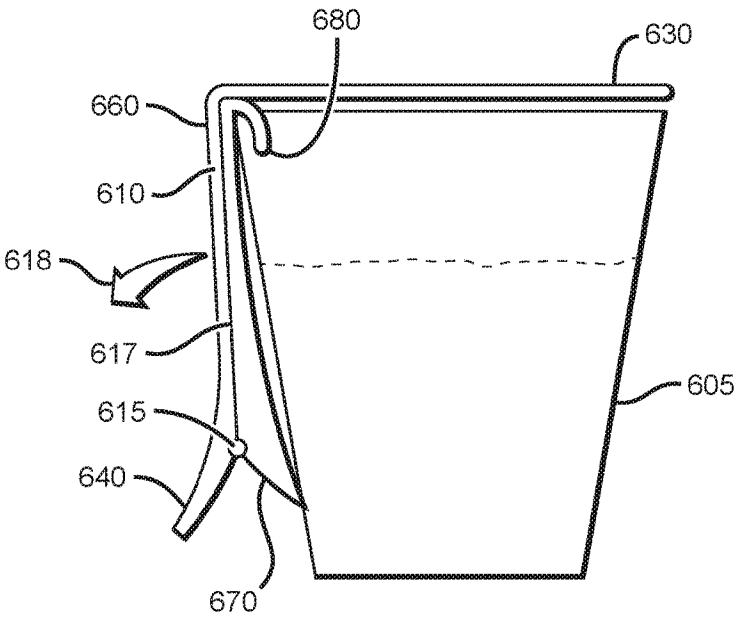

FIG. 6 shows a contemplated beverage container cover on the side of a highball glass.

Figure 7:
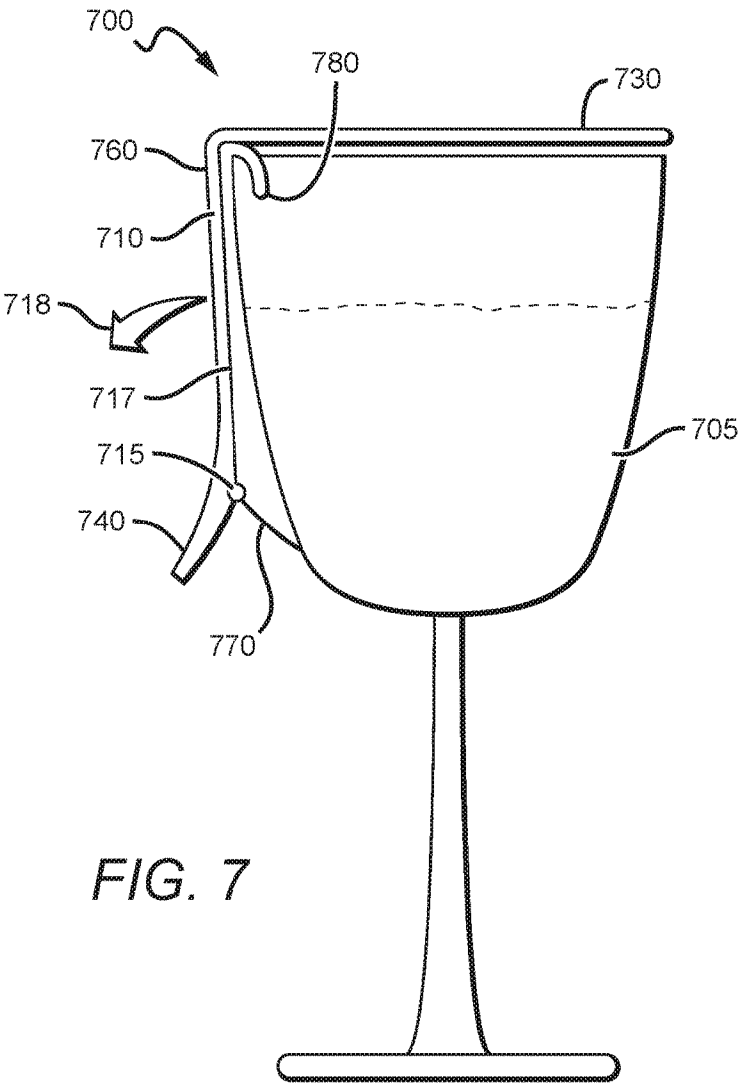

FIG. 7 shows a contemplated beverage container cover on the side of a wine glass.

DETAILED DESCRIPTION

A small, but effective system and apparatus for covering a beverage container that is currently in use by the person drinking the beverage has been developed and is described in detail herein. Contemplated systems and apparatus are able to be identified to and by the user, so that someone drinking a similar drink doesn't mistake his or her container for another one.

Contemplated embodiments were developed based on the concept of a "stein", which is a solid, often ceramic or metal, cup with a lid and a handle. Given that a stein isn't appropriate to drink out of in most conventional public gatherings, the contemplated beverage container cover was designed and developed.

Figure 1:
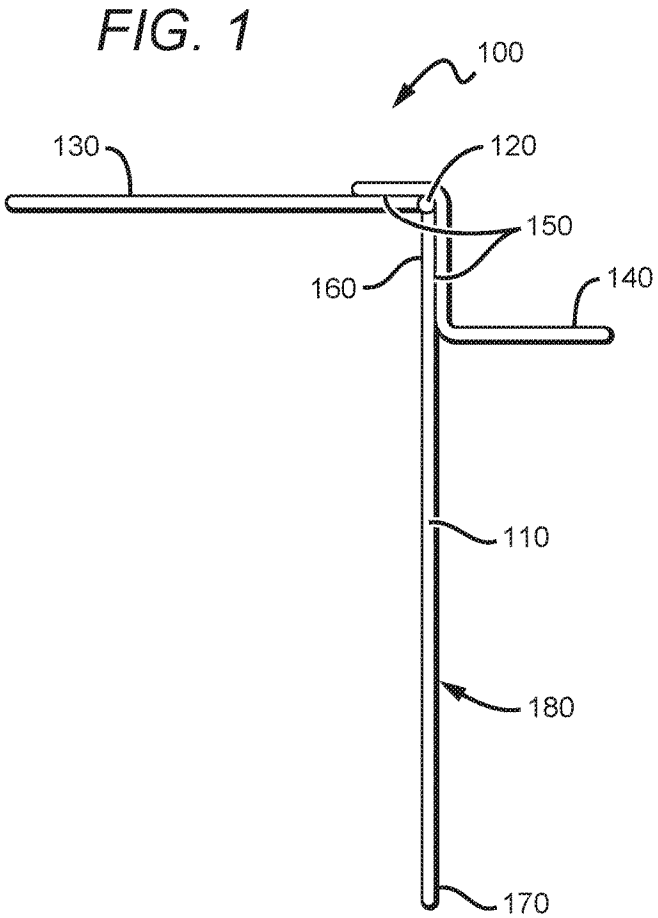

Specifically, a beverage container cover 100, as described herein, comprises a solid strip stabilizing component 110 hingeably 120 coupled to a cover component 130, and a handle component 140 that is operatively coupled 150 to the stabilizing component and the cover component, which is shown in FIG. 1.

A contemplated solid strip stabilizing component has a first end 160, a second end 170 and a body 180 that extends between the first and second end. The second end and the body, in this embodiment, is designed to be slipped down between a glass, bottle or can and an insulating cover for the glass, bottle or can—oftentimes called a coozie or koozie (290, 390 and 490 in the Figures), which is shown in FIG. 2 for a can, FIG. 3 for a bottle, and FIG. 4 for a glass, such as a beer glass.

Figure 2:
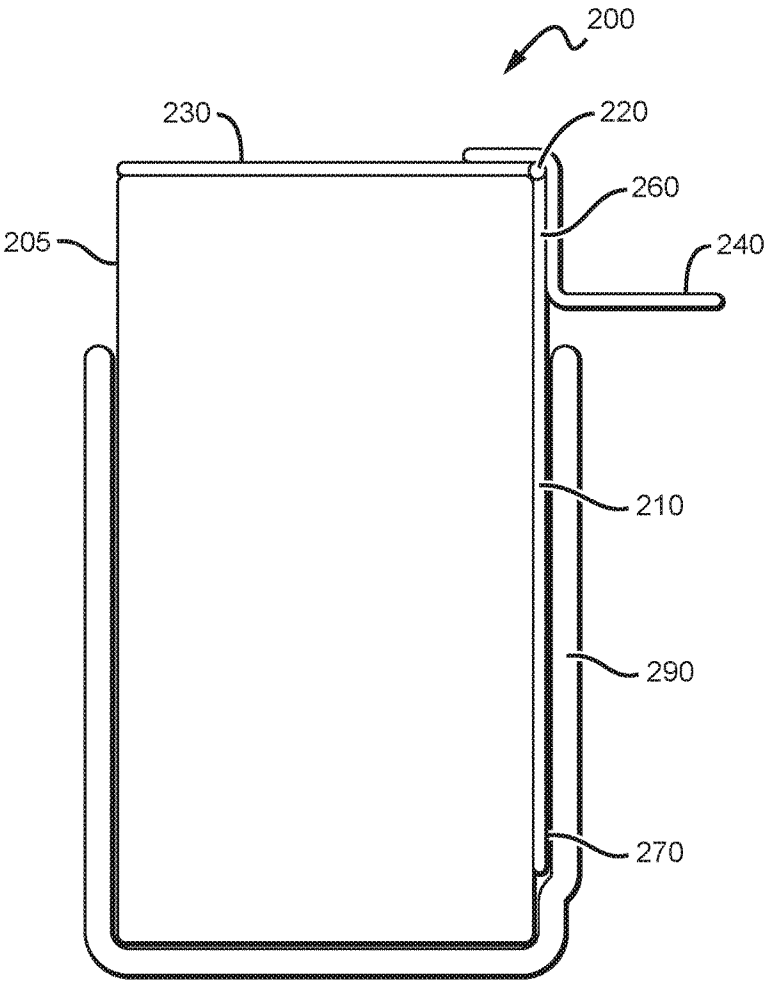
Figure 4:
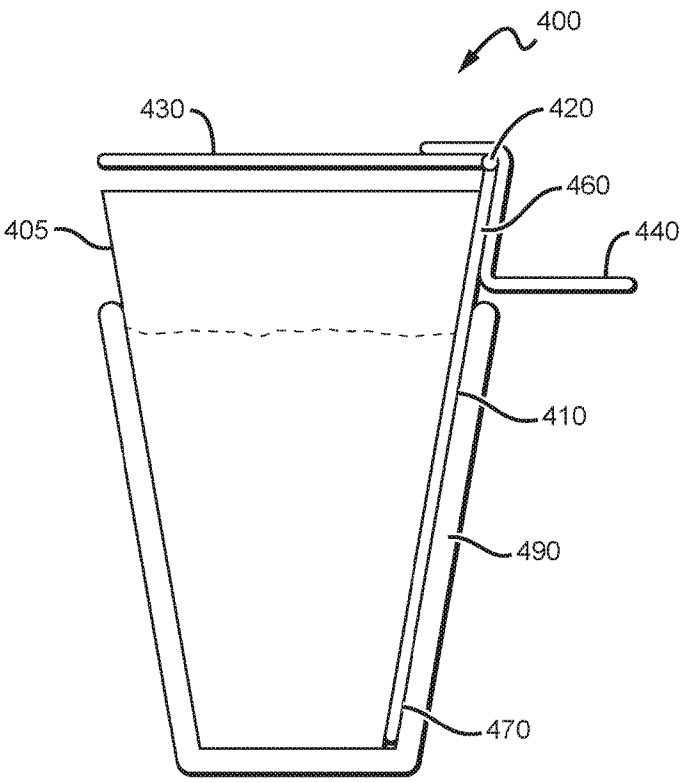
Figure 3:
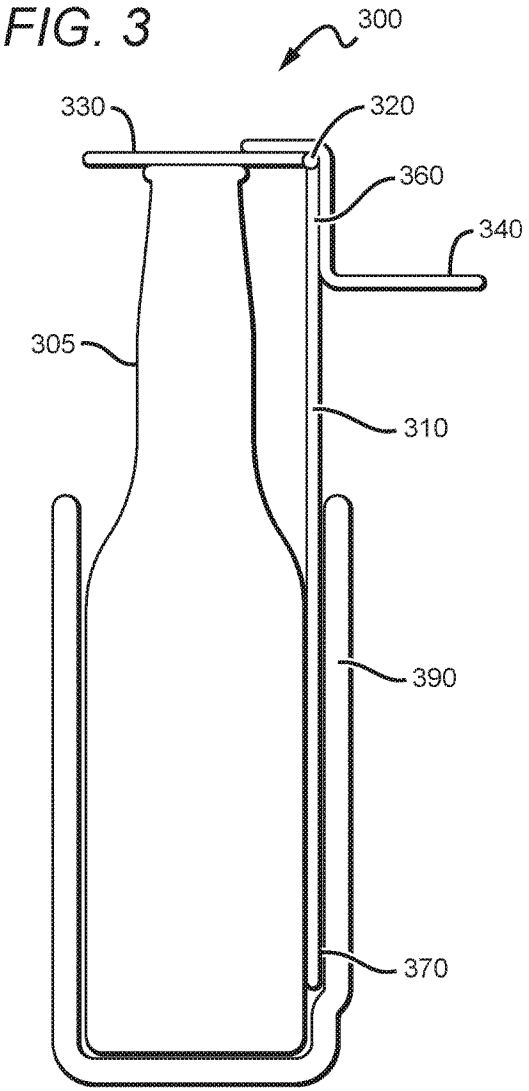

FIG. 2 shows a cross-section of a can 205 surrounded by a coozie 290, wherein a beverage container cover 200 is being utilized. FIG. 3 shows a cross-section of a bottle 305 surrounded by a coozie 390, wherein a beverage container cover 300 is being utilized. FIG. 4 shows a cross-section of a beer glass or pint glass 405 surrounded by a coozie 490, wherein a beverage container cover 400 is being utilized.

In FIG. 3, a beverage container cover 300, as described herein, comprises a solid strip stabilizing component 310 hingeably 320 coupled to a cover component 330, and a handle component 340 that is operatively coupled 350 to the stabilizing component and the cover component. A contemplated solid strip stabilizing component has a first end 360, a second end 370 and a body 380 that extends between the first and second end.

In FIG. 4, a beverage container cover 400, as described herein, comprises a solid strip stabilizing component 410 hingeably 420 coupled to a cover component 430, and a handle component 440 that is operatively coupled 450 to the stabilizing component and the cover component. A contemplated solid strip stabilizing component has a first end 460, a second end 470 and a body 480 that extends between the first and second end Once the second end 570 and body 580 of the solid strip stabilizing component 510 is slid 507 down between the glass, bottle or can (in this figure a can 505) and the insulating cover 590, the cover component 530 moves to sit on top of the opening of the glass, bottle or can 505, which is shown in FIG. 5. The cover component 530 is designed to cover the opening of the glass, bottle or can 505 with a degree of downward force, so that it can reliably cover the opening.

The handle component 540, as shown in FIG. 5, is designed to be pushed down 542 in order to pull or lift the cover component 510 up and off 544 of the opening of the glass, bottle or can 505, so that someone can drink from the beverage container 505.

When someone finishes the beverage, the beverage container cover is removed from the insulating cover, the glass, bottle or can is removed from the insulating cover and discarded. A new beverage is slid into the insulating cover and the beverage container cover is slid in between the beverage and the insulating cover.

In some embodiments, including those shown in FIGS. 6 and 7, a beverage container cover 600 and 700 is disclosed herein and includes: a solid strip stabilizing component 610 and 710, a cover component 630 and 730, wherein the solid strip stabilizing component 610 and 710 is hingeably coupled 615 and 715 to the handle component 640 and 740, and a handle component 640 and 740 that is operatively coupled to the stabilizing component 610 and 710, and the cover component 630 and 730. This design allows the beverage container cover to be slipped onto a glass, including those glasses having a stem, such as a wine glass or a martini glass. The stabilizing component comprises a hook 680 and 780 on the first end 660 and 760 that is designed to couple the stabilizing component to the edge of the glass 605 and 705. The second end 670 and 770 of the stabilizing component 610 and 710 is hingeably coupled 615 and 715 to the handle component 640 and 740. The handle component 640 and 740 is operatively coupled to the cover component 630 and 730, so that when the handle component 640 and 740 is engaged, the cover component 630 and 730 can be raised above the glass 605 and 705 or lowered onto the top of the glass 605 and 705 by using the two-piece stabilizing component 610 and 710 that is split lengthwise 617 and 717 like a clothes pin, so that the section coupled with the cover component can be engaged and pull away from the glass in the direction shown 618 and 718, and the section coupled to the hook and engaged with the glass can stay stable.

FIG. 6 shows a contemplated beverage container cover on the side of a highball glass. FIG. 7 shows a contemplated beverage container cover on the side of a wine glass. In both of these embodiments, the solid strip stabilizing component may be slightly curved in the direction of the glass, so that the stabilizing component can hold itself against the glass by force without the use of the koozie that is used in the other embodiments.

Contemplated components may be made from or may comprise one or more suitable materials, including plastic, metal or cardboard. Contemplated beverage container covers may also comprise any suitable design. These designs may comprise nonsensical or random designs, may comprise logos, trademarks or expressions, or a combination thereof. For example, a beer company may produce coozies and beverage container covers to package with their bottled or canned beer. The coozie and beverage container cover may be branded with the company logo, and in some instances, designs. It should be clear that the designs and combinations of these designs are only limited by the creativity of the designer or company producing the covers.

For example, some companies may choose to produce beverage container covers, where the cover component is in the shape or contains the company logo, or a logo or tagline for a new product line. High school, colleges and universities may use beverage container covers with school logos. Athletic teams and countries participating in Olympic sports may produce beverage container covers with logos and flags.

As disclosed, a contemplated cover component is hingeably coupled with a solid strip stabilizing component. As used herein, hingeably coupled means that the cover component and the solid strip stabilizing component or the handle component and the solid strip stabilizing component are joined together in a way that allows them to move relative to one another. "Hingably coupled" may mean that there is a score or perforation that joins the cover component with the solid strip stabilizing component or the handle component and the solid strip stabilizing component. It may also mean that there is a hinge arrangement that joins the cover component with the solid strip stabilizing component or the handle component and the solid strip stabilizing component.

The handle component is operatively coupled and affixed to both the cover component and the solid strip stabilizing component and reaches over the hinged attachment point, so that the handle component can work to remove the cover component from the open top of the beverage container. As used herein, the term "affixed" with respect to the handle component means that it may be injection molded with one or both of the other components or it may be adhesively or chemically attached to one or both of the other components.

Methods of using a beverage container cover system, include: providing the beverage container cover disclosed herein, providing a beverage container, providing an insulating cover, wherein the beverage container is surrounded in part by the insulating cover; and sliding the solid strip stabilizing component of the beverage container cover down between the space located between the beverage container and the insulating cover.

Thus, specific embodiments and methods of the open-container beverage container covers that can be used contemporaneously with drinking the beverage have been disclosed. It should be apparent, however, to those skilled in the art that many more modifications besides those already described are possible without departing from the inventive concepts herein. The inventive subject matter, therefore, is not to be restricted except in the spirit of the disclosure herein. Moreover, in interpreting the specification and claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

I claim:

1. A method of using a beverage container cover system, comprising:

providing a beverage container cover that comprises, a slidable solid strip stabilizing component, a cover component, wherein the solid strip stabilizing component is hingeably connected to the cover component by a hinge arrangement that joins the cover component with the solid strip stabilizing component, and a handle component that is operatively coupled to the stabilizing component and the cover component, wherein the beverage container cover is physically and entirely removable from an insulating cover that covers a glass, bottle or can providing a removable beverage container, providing an insulating cover, wherein the beverage container is surrounded in part by the insulating cover; and removably sliding the solid strip stabilizing component of the beverage container cover down between the space located between the beverage container and the insulating cover.

2. The method of claim 1, wherein the solid strip stabilizing component comprises a first end, a second end and a body that extends between the first and second end.

3. The method of claim 1, wherein the cover comprises plastic, metal, cardboard or a combination thereof.

4. The method of claim 1, wherein the cover comprises any suitable applied design, graphic design or logo.

* * * * *